US007891428B2

(12) United States Patent
Martin et al.

(10) Patent No.: US 7,891,428 B2
(45) Date of Patent: Feb. 22, 2011

(54) SAFETY VALVE

(75) Inventors: David Glen Martin, Aberdeen (GB); Roland Marcel Van Dort, Aberdeen (GB)

(73) Assignee: Caledyne Limited, Aberdeen (GB)

( * ) Notice: Subject to any disclaimer, the term of this patent is extended or adjusted under 35 U.S.C. 154(b) by 403 days.

(21) Appl. No.: 11/718,328

(22) PCT Filed: Nov. 2, 2005

(86) PCT No.: PCT/GB2005/004216

§ 371 (c)(1),
(2), (4) Date: May 14, 2007

(87) PCT Pub. No.: WO2006/048629

PCT Pub. Date: May 11, 2006

(65) Prior Publication Data

US 2009/0056948 A1 Mar. 5, 2009

(30) Foreign Application Priority Data

Nov. 2, 2004 (GB) ..... 0424255.8

(51) Int. Cl.
*E21B 23/00* (2006.01)
*E21B 33/00* (2006.01)

(52) U.S. Cl. ..... 166/332.8; 166/66.6; 166/66.7; 166/332.1; 166/386

(58) Field of Classification Search ..... 166/105, 166/108, 319, 154, 241.2, 332.1, 332.8, 325, 166/66.7, 66.6, 385, 386
See application file for complete search history.

(56) References Cited

U.S. PATENT DOCUMENTS 4,066,128 A * 1/1978 Davis et al. ..... 166/373
2002/0153139 A1 * 10/2002 Dennistoun et al. ..... 166/298

FOREIGN PATENT DOCUMENTS

CA 2244593 * 2/2000 ..... 166/319

* cited by examiner

*Primary Examiner*—Daniel P Stephenson
*Assistant Examiner*—Yong-Suk Ro
(74) *Attorney, Agent, or Firm*—Daniel N. Lundeen; Lundeen & Lundeen PLLC

(57) ABSTRACT

A safety valve for use in well bore operations, for example, in cooperation with a progressive cavity pump or rodpump. One version of a safety valve (1) is designed for use with upper and lower conduits in the form of upper and lower pump rod strings (16, 18) located in wellbore production tubing (50). The safety valve comprises a housing (2) having a longitudinal bore (3) extending therethrough; a coupling member (14) for coupling the upper rod string to the lower rod string, the coupling member sealably mounted within the longitudinal bore; an annular flow passage (8) bypassing the coupling member; and a valve sleeve (23) located in the annular flow passage. In use, the valve sleeve is utilised to control flow of fluid through the flow passage bypassing the coupling member.

46 Claims, 7 Drawing Sheets

SAFETY VALVE

CROSS REFERENCE TO RELATED APPLICATIONS

Not applicable

STATEMENT REGARDING FEDERALLY SPONSORED RESEARCH OR DEVELOPMENT

Not applicable

THE NAMES OF PARTIES TO A JOINT RESEARCH AGREEMENT

Not applicable

INCORPORATION BY REFERENCE OF MATERIAL SUBMITTED ON A COMPACT DISC

Not applicable

BACKGROUND OF THE INVENTION

The present invention relates to a safety valve for use in well bore operations. In particular, but not exclusively, the present invention relates to a safety valve for use in wellbore production tubing, for example, in cooperation with a progressive cavity pump or rodpump.

In the field of oil and gas drilling and well production, safety valves are commonly used in producing wells to prevent and contain accidents. For example, if downhole pressure exceeds a certain level, it is often a matter of urgency to shut in the well to prevent blowout and/or damage to equipment.

Less than a quarter of producing oil wells flow naturally. Therefore it is necessary to employ some means of artificial lift, for example a pump of some description. Such artificial lift means are also employed in subsea operations and in difficult locations in order to boost production.

Progressive cavity pumps (PCP) are generally employed in low flowrate applications where there is not enough lift to cause problems. Progressive cavity pumps are flexible and reliable, and in general resistant to abrasive solids. In comparison to some other pumping methods the PCP produces an almost fluctuation-free flow out of a well. PCPs are also durable and less prone to damage than, for example, ESP pumps.

However, in subsea drilling and the majority of offshore operations there is a strict requirement for failsafe safety systems to be employed. These failsafe systems are often safety valves that can be closed automatically in the event of a problem.

A typical safety valve employed in the art is a flapper valve. This kind of valve is biased closed in general by a spring which forces the flapper upwards against a sealing surface. Typically an actuation means such as a rod or a sleeve is provided, and is controlled by a hydraulic line from surface which, when actuated, moves the flapper to an open position. Removal of pressure will cause the flapper to close again.

This kind of safety valve is useful for shutting in a well when there is a problem occurring downhole. However, such flapper valves are unsuitable for progressive cavity pumps, where a conduit in the form of a rod string is required to pass through the bore of the system down to the PCP rotor. The PCP is typically located below what would be the location of a failsafe valve.

One solution in the art is to use a rod string with a modified end which pushes open the flapper valve and continues moving downwards to mate with the PCP rotor or a further rod string connected to the PCP rotor. Should a problem occur downhole the rod can be pulled, disengaging from the rotor and, once clear of the flapper, the safety valve can be closed. However, as discussed above, it is clear that should a problem occur at the surface and the rod cannot be pulled then the valve will remain open.

There is little provision for failsafe valves that allow PCPs or rod pumps to be driven therethrough, while maintaining a valve that can be actuated regardless of whether the problem is downhole or at the surface. Furthermore there is little provision for failsafe valves that allow the valve to be opened or closed irrespective of whether the rod is inserted or retracted, or conversely that allow PCPs to be driven therethrough regardless of whether the valve is open or closed.

These problems and disadvantages apply equally in relation to use of safety valves with other downhole equipment such as drill strings, artificial lift equipment such as gas lift pipes, and electrical/fibre-optic/hydraulic penetrators. For example, a rotary drill string suffers from similar disadvantages in terms of an inability of prior safety valves to facilitate drive transfer through the valve whilst maintaining the ability to quickly close the valve. In the case of gas lift pipes and penetrators, whilst it is not necessary in these cases to transfer drive through the valve, the problem of requiring the gas lift/penetrator string to be pulled to close the safety valve remains.

It is an object of at least one embodiment of the present invention to provide a safety valve that obviates OR mitigates at least one limitation of the prior art.

According to a first aspect of the present invention, there is provided a safety valve for use with upper and lower conduits located in wellbore production tubing, the safety valve comprising:

a housing having a longitudinal bore extending therethrough;

a coupling member for coupling the upper conduit to the lower conduit, the coupling member sealably mounted within the longitudinal bore;

an annular flow passage bypassing the coupling member; and valve means located in the annular flow passage.

Preferably, the upper conduit is an upper tubing string and the lower conduit is a lower tubing string. The tubing strings may provide a mechanical support and/or may define a fluid flow path to enable a downhole operation to be conducted.

The coupling member may serve for fluidly coupling the upper conduit to the lower conduit, to permit fluid flow therebetween. This may facilitate use of the safety valve with gas lift tubing or pipe comprised of upper and lower conduits in the form of upper and lower tubing strings, where an upper gas lift tubing section is to be coupled to a lower gas lift tubing section. This may enable injection of gas into the production tubing below the valve (in an artificial, gas-lift procedure), whereby recovery of well fluids is stimulated, the well fluids flowing through the annular flow passage into the production tubing above the valve and to surface.

The coupling member may be adapted to be connected to one of the upper and lower conduits, and the housing may be adapted to be connected to the other one of the upper and lower conduits. Accordingly, by sealingly mounting the coupling member in the housing bore, the upper and lower tubing strings may be fluidly coupled, and the connecting member may therefore serve for indirectly connecting the upper and lower tubing strings together.

Alternatively, the coupling member may serve for connecting the upper and lower conduits together, and may therefore serve for directly connecting the conduits.

The coupling member may comprise a tubing section, pipe, sub or the like which may serve for coupling the upper and lower conduits and may therefore be adapted to form part of a completed conduit extending through the valves.

The coupling member may take the form of a penetrator body, the penetrator body serving for coupling the upper and lower conduits which may be upper and lower penetrator conduits. The upper and lower penetrator conduits may comprise or take the form of tubes, pipes, wires and/or cables and may be electrical, fibre-optic and/or hydraulic tubes, pipes, wires or cables and may serve for providing power and/or control signals to downhole equipment, particularly pumps such as electrical submersible pumps (ESPs). Accordingly, when the upper and lower conduits are coupled, supply of power and/or control signs to downhole equipment may be facilitated. Additionally, by sealably mounting the penetrator body in the housing bore, return flow of fluid (such as well fluids lifted by the pump) may be directed along the flow passage whilst the body provides connection between the upper and lower penetrator conduits.

Preferably however, the coupling member takes the form of a motion transferring member arranged to provide a means to provide motion from the upper conduit to the lower conduit. The safety valve may be for use with upper and lower conduits in the form of upper and lower tubing strings, which may be upper and lower rod strings of a pump. Alternatively, the safety valve may be for use with upper and lower conduits in the form of upper and lower tubing strings which may be respective sections of a drill string, or any other downhole tubing of a type where motion is to be transferred through the safety valve.

According to a second aspect of the present invention there is provided a safety valve for use with upper and lower rod strings in production tubing when located within a well bore, the safety valve comprising a substantially cylindrical housing with a longitudinal bore therethrough, the cylindrical housing containing a motion transferring member, the motion transferring member sealably mounted within the longitudinal bore but arranged so as to provide a means to transfer motion from the upper rod string to the lower rod string, and an annular flow passage bypassing said motion transferring member, the annular flow passage having valve means located therein.

The annular flow path and valve means therein provides a fluid path which can be opened and closed to regulate flow in a production string. The motion transferring member provides a means of transferring motion from above the safety valve to below the safety valve without compromising the effectiveness of the valve means.

Most preferably and advantageously the valve means is an annular valve. Annular valves are well known in the art and are very effective in shutting off producing wells. Such a valve would allow the motion transferring member to move within the housing whether the valve was open or closed.

Preferably the coupling/motion transferring member comprises a hollow, substantially cylindrical body. Preferably the motion transferring member forms a sealtight fit within the longitudinal bore.

Preferably the annular flow passage divides a substantial portion of the housing into an outer cylindrical housing and an inner cylindrical housing.

The annular cavity allows the fluid to bypass the coupling/motion transferring member, and the annular valve located therein opens or closes to allow or prevent fluid flow up the production tubing.

Preferably the annular valve comprises a hollow cylindrical valve sleeve surrounding a hollow cylindrical valve body. Preferably the cylindrical valve body is an integral part of the inner cylindrical housing. Preferably the valve sleeve is movable along the valve body. Preferably the valve sleeve has one or more valve sleeve apertures. Preferably the valve body has one or more valve body apertures. The valve is open when the valve sleeve moves to a position where the sleeve apertures align with the valve body apertures.

Most preferably the annular valve has an actuation means which displaces the valve sleeve of the annular valve. This actuation means therefore controls the opening and closing of the valve, allowing and preventing fluid flow within the tubing.

Preferably the actuation means for the annular safety valve is a rod piston. Preferably the rod piston is located in a longitudinally extending rod piston cavity.

Preferably the rod piston is axially moveable within the rod piston cavity. Preferably movement of the rod piston is effected by means of hydraulic fluid pressure within the rod piston cavity.

Preferably the rod piston is biased with a spring. In this way the piston, and hence the valve can be biased to be default open or default closed.

Preferably the rod piston cavity is in fluid communication with a hydraulic control line port located at an outer surface of the substantially cylindrical housing. Preferably the hydraulic control line port connects to a control line. Preferably the control line extends to the top of the wellbore. This will allow the annular valve to be opened or closed from the surface by controlling hydraulic fluid pressure in the control line.

Optionally there is an intermediary stage between the hydraulic control line port and the control line. Preferably the intermediary stage is a component of a downhole fixture located in the wellbore. In particular embodiments, the safety valve may be adapted to be located in an existing downhole valve. Accordingly, the downhole fixture may be a sub-surface safety valve (SSSV) and may be locked open. The SSSV may take the form of a tubing retrievable surface controlled safety valve (TRSCSV). In this way, the control line of an existing, already installed, downhole component can be employed to actuate the safety valve of the present invention. In these embodiments, the safety valve of the invention may be adapted to engage within a main bore of the existing valve, which may be locked open by the safety valve or using the existing valve control equipment.

Preferably the movement of the motion transferring member is restricted to rotational motion. This facilitates the transfer of rotational motion from an upper rod string to a lower rod string, allowing for example a progressive cavity pump to be driven from the surface, or transfer of motion between upper and lower drill strings or other rotatable tubing strings.

Alternatively the movement of the motion transferring member is restricted to axial motion. This alternative allows the transfer of an axial reciprocation of the upper rod string to the lower rod string, allowing for example a rod pump to be driven from the surface.

Preferably sealing means are provided between the coupling/motion transferring member and the housing. This ensures that any fluid flow is either prevented or directed through the annular flow passage, depending on whether the annular valve is closed or open, respectively.

The sealing means maybe a plurality of circumferentially extending seals. The circumferentially extending seals maybe located within circumferentially extending recesses on an outer surface of the coupling/motion transferring member. Alternatively the circumferentially extending seals are located within circumferentially extending recesses on an inner surface of the longitudinal bore.

Preferably a bearing means is provided between the coupling/motion transferring member and the substantially cylindrical housing. This bearing means reduces friction between the motion transferring member and the housing.

The valve may comprise means for connecting the coupling/motion, transferring member to the upper conduit which may comprise a female receptacle integral to the coupling/motion transferring member and a male insert provided on or adapted to be coupled to the upper conduit.

The male insert may comprise a spline shaft, and the female receptacle may comprise a spline sleeve into which the spline shaft forms an interference fit. The spline shaft and spline sleeve mate to form a connection capable of transferring rotational motion.

Preferably the male insert further comprises a locking mechanism. The locking mechanism is to hold the spline shaft within the spline sleeve and prevent unwanted retraction of the upper conduit.

The locking mechanism may comprise a key. The female receptacle may comprise a recess with which the key can communicate. As the upper conduit with the male insert is lowered into the safety valve, the key locates within the recess and prevents the upper conduit from being forced upwards.

Preferably the male insert further comprises a non-rotating mandrel. Preferably the locking mechanism is an integral part of the non-rotating mandrel. Most preferably and advantageously the upper conduit is free to rotate within the non-rotating mandrel. This means that the locking mechanism does not rotate, and only the upper conduit rotates, making the locking mechanism more effective.

Preferably the male insert further comprises a no-go key. Most preferably the no-go key is fixed in location on the non-rotating mandrel. Preferably the female receptacle further comprises a shoulder with which the no-go key communicates. The no-go key and the shoulder contact to stop the upper conduit travelling too far downwards.

The valve may comprise means for connecting the coupling/motion transferring member to the lower conduit, which may comprise a female receptacle integral to the coupling/motion transferring member and a male insert provided on or adapted to be coupled to the top end of the lower conduit.

Optionally the lower conduit is a lower rod string and may be a PCP rotor.

Preferably the top end and the bottom end of the housing are adapted for connection to production tubing.

Optionally, the means of connecting the coupling/motion transferring member to the lower conduit further comprises a torque reducing means. A PCP rotor in rotation often results in a transfer of torque to the rod string driving the rotation. This creates a backlash rotation wherein the rod string moves in a circular path within the bore. A torque reducing means would reduce the transfer of this torque into the safety valve.

Whilst the above aspects of the invention have been defined in relation to a safety valve for use with tubing strings located in wellbore production tubing, it will be understood that the safety valve may be utilised in any desired, suitable downhole tubing such as casing, liner or the like. Equally, it will be understood that the safety valve may be for use with any suitable upper and lower tubing strings. The safety valve may also have uses in other types of tubing such as pipelines.

Further features of the present invention are defined in the claims.

BRIEF DESCRIPTION OF THE SEVERAL VIEWS OF THE DRAWINGS

The present invention will now be described, by way of example only, with reference to the accompanying drawings, in which.

DETAILED DESCRIPTION OF THE INVENTION

Figure 1:
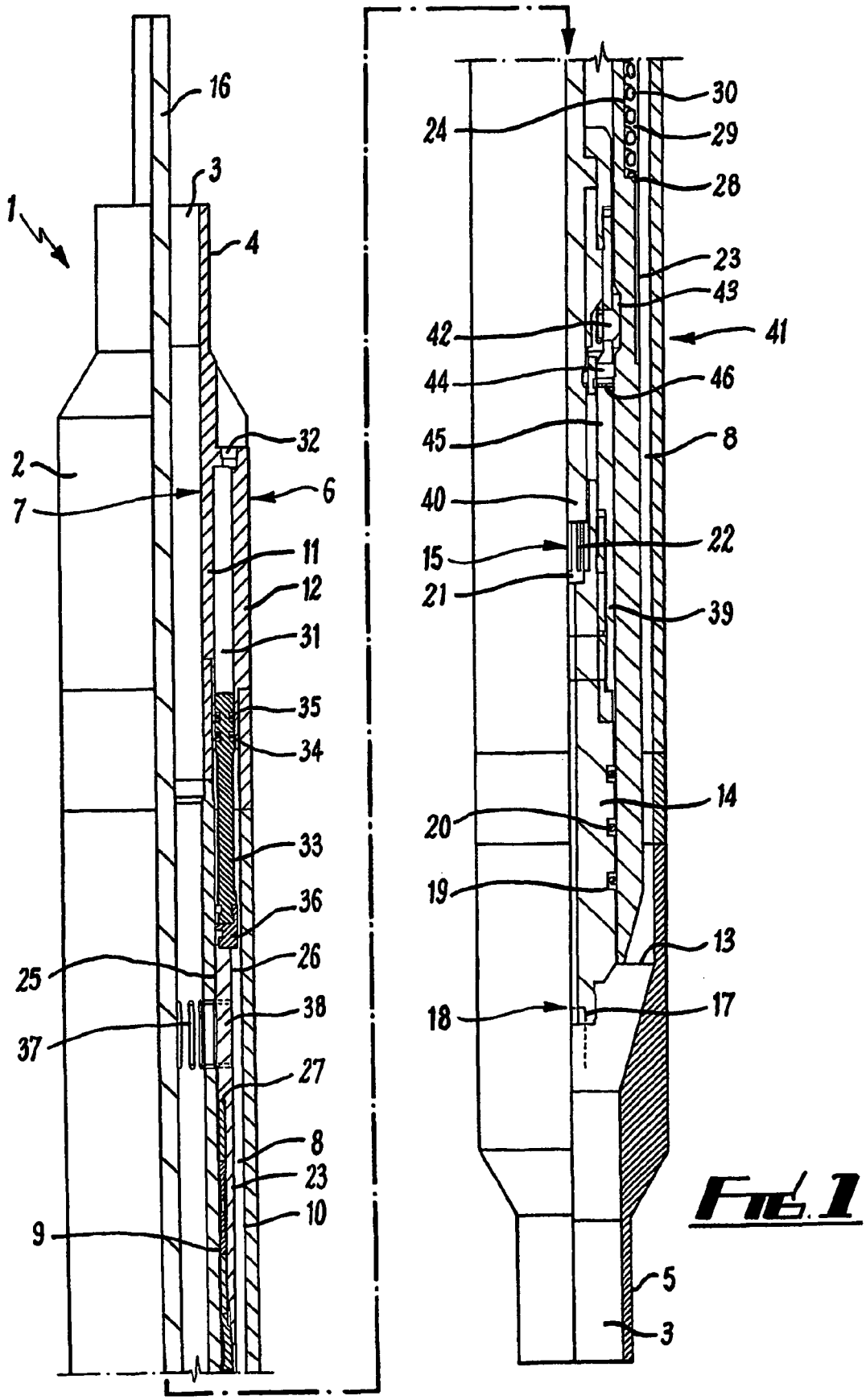
FIG. 1 is a part cross-sectional view a safety valve in accordance with an embodiment of the present invention.

With reference to FIG. 1, there is presented a safety valve 1 that functions to selectively open and close a well production as described in detail below. The safety valve 1 comprises a cylindrical housing 2, with a central bore 3 running there through, and having a top 4 and a bottom end 5. The outer diameter of the housing 2 defines a housing outer surface 6, and the central bore 3 defines an inner diameter of the housing 6 and a housing inner surface 7. The top 4 and bottom 5 ends of the safety valve 1 are adapted for connection to a production string (not shown).

Between the housing outer surface 6 and the housing inner surface 7 is located an annular passageway 8, distinct from the central bore 3. The inner diameter of the annular passageway 8 is larger than the inner housing diameter and the outer diameter of the annular passageway 8 is less than the housing outer diameter. The annular passageway 8 thus defines an inner annular surface 9 and an outer annular surface 10, and splits the housing 2 into an inner housing 11 and an outer housing 12.

The central bore 3 widens towards the bottom end 5 of the housing 2, and the annular passageway 8 extends downwards and is open to fluid communication at the bottom end 5 of the safety valve 1 via an annular aperture 13 thus formed. The top end of the annular passageway 8 is closed to fluid communication.

Disposed near the bottom end 5 of the safety valve 1 is a rotary section 14. The rotary section 14 is situated within the central bore 3, with a top end 15 adapted for connection to an upper rod string 16, and a lower end 17 adapted for connection to a lower rod string 18. The rotary section 14 provides a transfer of torque from the upper rod string 16 to the lower rod string 18 without compromising the safety valve 1. The rotary section 14 is free to rotate within the central bore 3, with no transfer of rotational motion to the rest of the safety valve 1.

The rotary section 14 has three circumferentially extending recesses 19 on the outer surface, within which are located rotary seals 20, maintaining a seal between the bottom end 5 of the safety valve 1 and the central bore 3 above the rotary section 14. Additionally, the top end 15 of the rotary section 14 comprises a mating sleeve 21 adapted to receive a spline shaft 22. The spline shaft 22 and the mating sleeve 21 form an interference fit capable of transferring torque.

Within the annular passageway 8 is located a valve sleeve 23. A longitudinally and circumferentially extending annular recess 24 on the inner annular surface 9 provides a means of locating the valve sleeve 23 within the annular passageway 8. The recess 24 and the valve sleeve 23 are sized to allow the valve sleeve 23 to reciprocate axially within the annular passageway 8.

The valve sleeve 23 has an inner valve sleeve surface 25 and an outer valve sleeve surface 26. The inner valve sleeve surface 25 forms a valve sleeve shoulder 27; likewise an annular recess shoulder 28 is formed in the annular recess 24 on the inner annular surface 9, located beneath the valve sleeve shoulder 27. The valve sleeve shoulder 27 and the annular recess shoulder 28 define a spring cavity 29. The spring cavity 29 contains a spring 30 in compression. The lower end of the spring 30 pushes against the annular recess shoulder 28 and the upper end of the spring 30 pushes against the valve sleeve shoulder 27 and biases the valve sleeve 23 in an upwards direction.

Within the housing 2 is further located a cylindrical, longitudinally extending piston cavity 31, distinct from and parallel to the central bore 3, extending from the top end of the annular passageway 8 in an upwards direction to the housing outer surface 6. Where the piston cavity 31 meets the housing outer surface 6 is located a piston cavity port 32, which provides fluid communication between an external fluid source (not shown) and the piston cavity 31.

The piston cavity 31 contains a rod piston 33, axially movable therein. The rod piston 33 is cylindrical, with two circumferential recesses 34 at a top end. Within these circumferential recesses 34 are located sealing rings 35 which form a seal between the rod piston 33 and the piston cavity 31. At a bottom end of the rod piston 33 is a connector 36 that joins the rod piston 33 to a top end of the valve sleeve 23, such that axial reciprocation of the rod piston 33 results in axial reciprocation of the valve sleeve 23.

The fluid pressure in the piston cavity 31 governs the axial reciprocation of the rod piston 33. By increasing the pressure of the fluid in the piston cavity 31 the upwards biasing force of the spring 30 can be overcome to move the piston 33 and the valve sleeve 23 downwards.

There are a number of circumferentially distributed housing ports 37 in the inner housing 11 allowing communication between the central bore 3 and the annular passageway 8. The valve sleeve 23 also has a number of circumferentially distributed sleeve ports 38, situated to coincide with the housing ports 37 when the rod piston 33 and valve sleeve 23 are moved fully downwards. Therefore, by controlling the fluid pressure in the piston cavity 31, the ports 37, 38 can be aligned and misaligned. The default position, with low piston cavity 31 fluid pressure, is closed, requiring an increase in fluid pressure to align the ports 37, 38.

When the ports 37, 38 are aligned, fluid passage is permitted between the bottom end 5 of the safety valve 1, which is in communication with downhole gas or oil (not shown), through the valve sleeve ports 38 and the inner housing ports 37, into the central bore 3 and up to the top end 4 of the safety valve 1. This corresponds to an operating position in which the well is open to production. Conversely, moving the valve sleeve 23 to take the inner housing ports 37 and the valve sleeve ports 38 out of alignment corresponds to an operating position in which the well is shut in.

Transfer of rotational motion from the upper rod string 16 to a lower rod string 18 is possible regardless of the operating position of the safety valve 1. Rotational motion is assisted by a bearing 39 which reduced the friction between the inner housing 11 and the rotary section 14.

The upper rod string 16 has a modified lower end 40, adapted for connection to the rotary section 14 of the safety valve 1. The lower end 40 of the upper rod string 16 forms a spline shaft 22, for inserting in the mating sleeve 21 of the rotary section 14. When inserted, a locking mechanism 41 holds the upper rod string 16 in place.

The locking mechanism 41 consists of a key 42 which is integral to the lower end 40 of the upper rod string 16. The key 42 locates within a landing nipple 43, which is integral to the inner housing 11 and part of the central bore 3. Additionally, the lower end 40 of the upper rod string 16 comprises a no-go key 44 and the inner housing 11 comprises a latch body 45 which defines a shoulder 46 at its upper end. When the upper rod string 16 is lowered through the central bore 3, the no-go key 44 comes to rest on the shoulder 46, preventing additional downwards motion. Any additional downwards motion might damage the rotary section 14, which by this point is connected to the upper rod string 16 by virtue of the mating sleeve 21 and the spline shaft 22.

Figure 2:
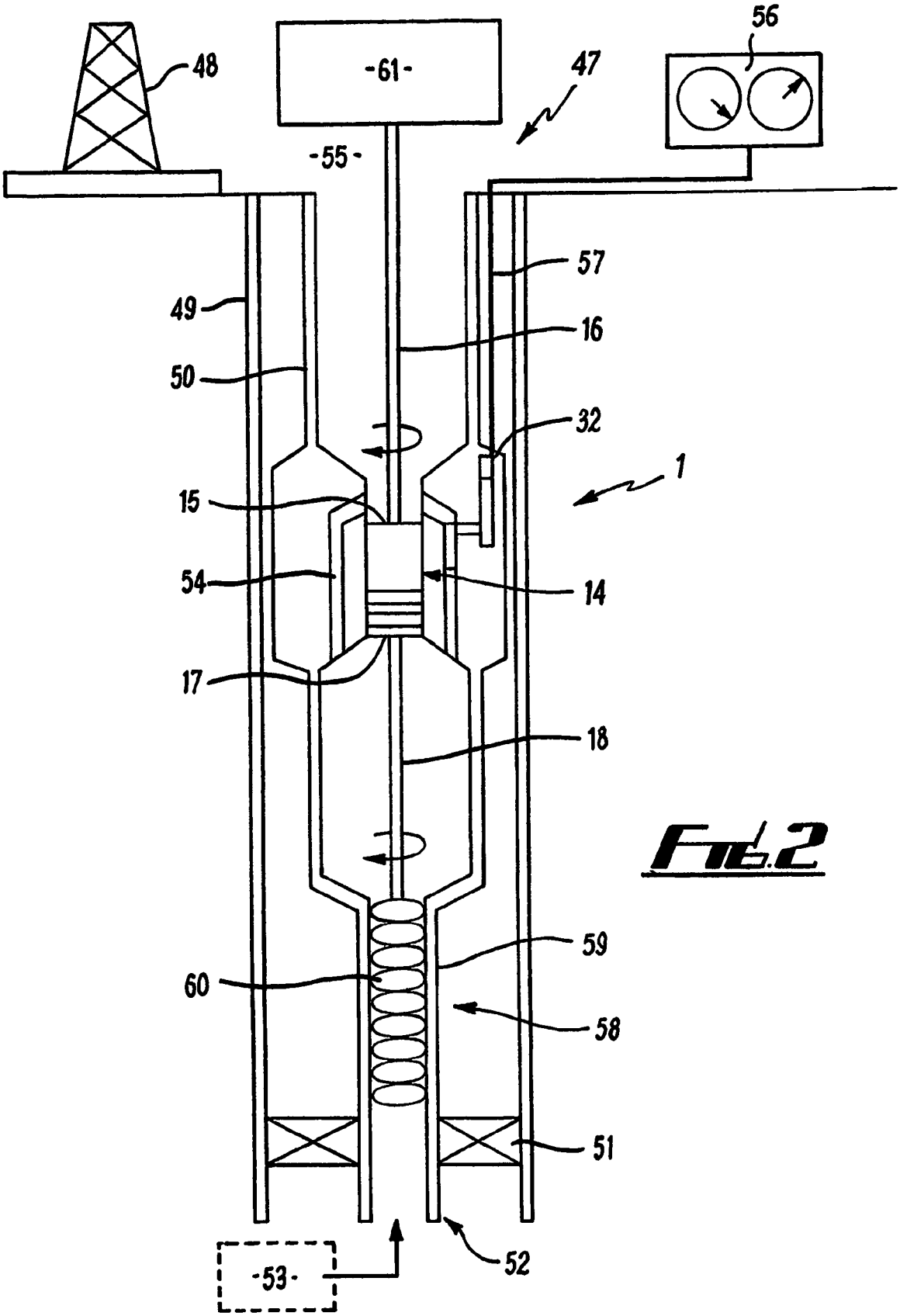
FIG. 2 is a schematic view of the safety valve of FIG. 1 shown in use, disposed within a wellbore.

FIG. 2 shows a schematic representation of the safety valve 1 disposed within a producing wellbore 47, particularly a rig 48 wellbore 47. The wellbore 47 comprises a casing 49, within which a production tubing 50 is set in place with a packer 51. The bottom end 52 of the production tubing 50, beneath the packer 51, is in fluid communication with formation fluids 53; namely gas and oil.

Located near a top end of the wellbore 47 is positioned the safety valve 1 of the present invention. The safety valve 1 is connected at the top 4 and bottom 5 ends to the production tubing 50. When open, the annular flow path 54 bypasses the rotary section 14 within the safety valve 1, facilitating flow of formation fluids from the bottom 52 of the production tubing 50 to the surface 55. The rotary section 14 is located therein to permit transfer of rotational motion from above the safety valve 1 to below the safety valve 1, with no adverse effects on the operation of the valve 1.

A control panel 56 governs the fluid pressure supplied to the safety valve 1 via the control line 57 and the piston cavity port 32. When well production is in progress, the fluid pressure is high to align the inner housing ports (not shown) and the valve sleeve ports (not shown) and permit fluid flow there through. If a problem is detected, or a fault occurs, the control panel 56 will reduce the fluid pressure such that the inner housing ports (not shown) and the valve sleeve ports (not shown) are out of alignment and the well 47 is shut in.

The production wellbore 47 illustrated uses a progressive cavity pump 58 to enhance lift of the formation fluids 53. The progressive cavity pump 58, as is known in the art, comprises a PCP stator 59 and a PCP rotor 60. The PCP rotor 60 is single helical in shape, and the stator 59 is double helical in shape. Rotation of the rotor 60 within the stator 59 results in a progressing cavity which creates an upwards flow of fluid.

Rotation of the rotor 60 is effected from the surface 55 via an upper rod string 16. At the surface 55 the upper rod string 16 is rotated by a top drive 61 such as is used to turn drill stems.

The upper rod string 16 is attached to the upper end 15 of the rotary section 14 located within the safety valve 1, and the lower rod string 18 is attached to the lower end 17 of the rotary section 14 within the safety valve 1. Therefore when the top drive 61 drives the rotation of the upper rod string 16, the lower rod string 18 rotates due to the transfer of rotational motion through the safety valve 1. The lower rod string 18 rotation will result in rotation of the PCP rotor 60 and create an upwards flow of formation fluid 53. Meanwhile the safety valve 1 may be closed and re-opened as and when required.

One advantage of the current system is that it allows progressive cavity pumps to be deployed in subsea operations, particularly in operations where the safety regulator insists that a failsafe barrier is provided. This could be in offshore wells such as in the North Sea or Gulf of Mexico, or indeed land wells where there is such a requirement. Failsafe devices are prerequisites of subsea operations; in the event of a problem occurring the production needs to be shut in to prevent formation fluids from polluting the sea.

Current safety valves such as the flap and ball type require retraction of the pump or production string to close the valve. If a problem occurs downhole this is generally possible, however if the problem occurs at the surface, sometimes the string cannot be pulled. This makes such systems problematic.

The advantage of the present invention is that the valve is controlled separately from the string and as such can be opened or closed whether a fault is downhole or at the surface.

The transfer of rotational motion through the valve also allows PCP pumps to be used in such systems, which was not permissible before due to concerns over safety.

Furthermore, the use of an annular type valve means that the well can be shut in even at high rates.

By allowing for the capability to have an intermediary stage to transfer hydraulic pressure from the control line to the hydraulic control line port, it is possible to run the safety valve of the present invention into an existing downhole component comprising the intermediary stage. This allows the present invention to also take advantage of existing control lines rather than requiring a dedicated control line in every application, as will now be described.

Figure 3A:
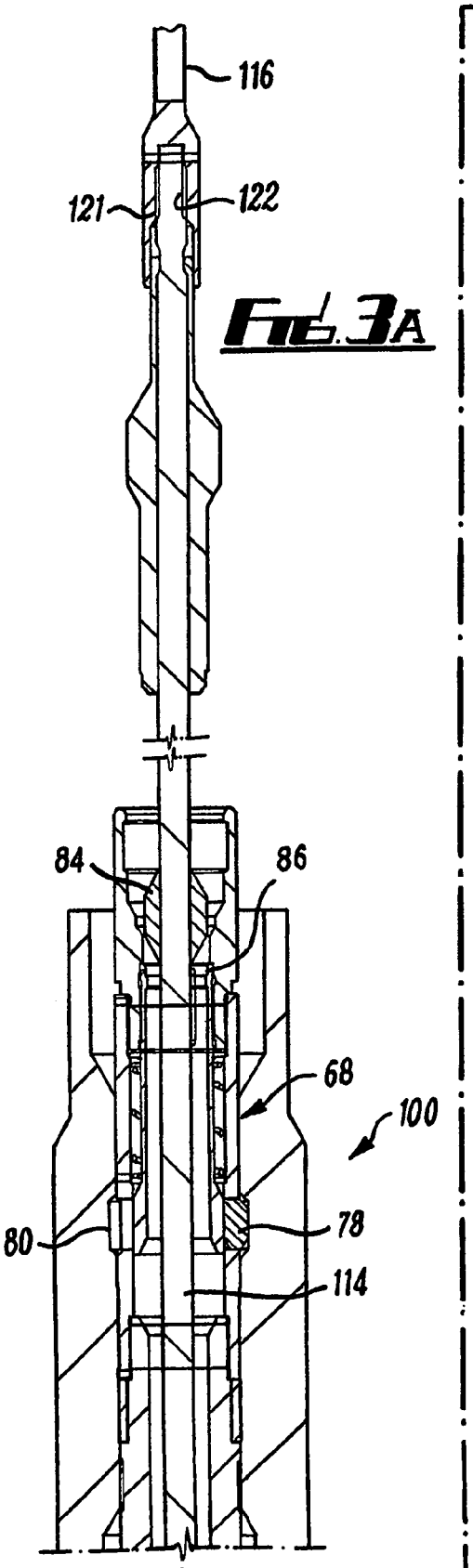
FIGS. 3A to 3C are longitudinal sectional views, from top to bottom, of a safety valve in accordance with an alternative embodiment of the present invention.
Figure 3B:
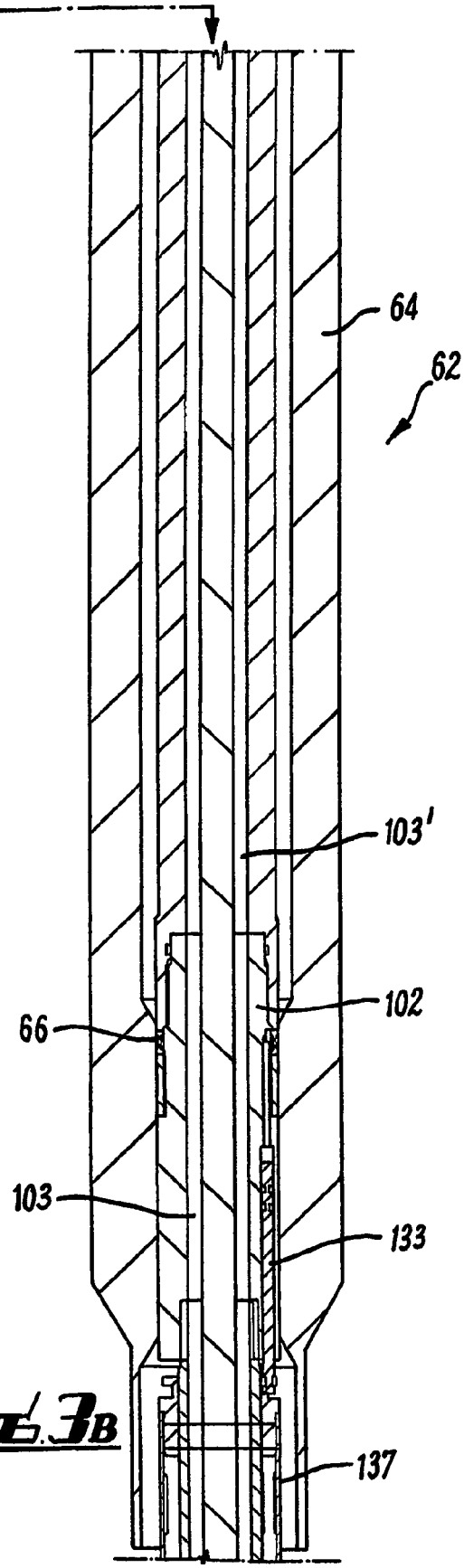
Figure 3C:
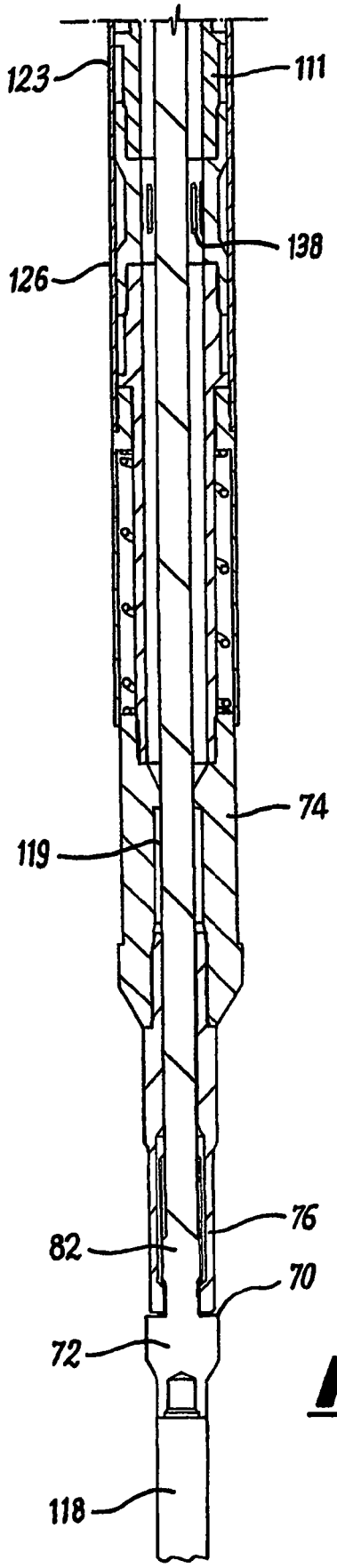

Accordingly, turning now to FIGS. 3A to 3C, there is shown sequentially from top to bottom a longitudinal sectional view of a safety valve in accordance with an alternative embodiment of the present invention, the safety valve indicated generally by reference numeral 100. An upper end of the safety valve is thus shown in FIG. 3A and a lower end in FIG. 3C. Like components of the safety valve 100 with the valve 1 of FIGS. 1 and 2 share the same reference numerals, incremented by 100. Only the substantial differences between the valve 100 and the valve 1 will be described herein in detail.

The valve 100 is shown latched into an existing sub-surface safety valve (SSSV) 62. The SSSV 62 has a valve housing 64 which is coupled to production tubing in a wellbore (not shown), in a similar fashion to the housing 2 of the valve 1. In the illustrated embodiment, the SSSV 62, which typically includes a flapper valve (also not shown), has failed and is no longer able to operate adequately to shut-off flow through the wellbore. The safety valve 100 has been run into the production tubing on an upper conduit in the form of an upper pump rod string 116, and is coupled at a lower end to a lower conduit in the form of a lower pump rod string 118. The lower rod string 118 is coupled to and drives a rotor of a pump (not shown), such as the pump 58 shown in FIG. 2. Prior to running of the valve 100, the SSSV flapper is locked open, and the valve 100 is then run and latched into the SSSV housing 64, as shown in the Figures. In this fashion, existing control equipment of the SSSV 62 may be utilised to actuate the safety valve 100, as will be described below.

The valve 100 includes a valve sleeve 123 having a number of sleeve ports 138, and an inner housing 111 having a number of ports 137. The sleeve 123 is coupled to a rod piston 133, which is in fluid communication with a fluid inlet 66 of the SSSV valve housing 64. Reciprocation of the rod piston 133, and thus axial alignment of the sleeve ports 138 and the inner housing ports 137, is controlled by an existing control line (not shown) which is in fluid communication with the inlet 66 of the SSSV housing 64, in a similar fashion to that described above in relation to the valve 1. When the ports are aligned, fluid flows up an annulus defined between the production tubing and the external surface 126 of the valve sleeve 123, through the ports 138 and 137, along a central bore 103 of the valve 100, into an annulus 103' defined between the SSSV housing 64, and into the production tubing above the valve.

The valve 100 includes a rotary section 114 in the form of a connecting rod, which connects the upper rod string 116 to the lower rod string 118, and permits transfer of a rotary drive force to the pump. The connecting rod 114 extends through the SSSV valve housing 64 and through a housing 102 of the valve 100, and includes a splined portion 122 which mates with a splined sleeve 121 on the upper rod string 116.

The valve 100 is latched into the SSSV valve housing 64 by a proprietary locking mechanism 68, such as that commercially available from the Applicant, which restrains the main valve housing 102 against further axial movement relative to the SSSV housing 64. During run-in, the valve 100 is supported on a shoulder 70 of a body 72 provided at a lower end of the connecting rod 114, and the valve 100 includes a lower sub 74 carrying a collet 76 which engages around the connecting rod 114. When the valve 100 has been located within the SSSV housing 64, further downward movement of the housing 102 is then prevented by virtue of a no-go shoulder in the SSSV housing. At this point, a fluted running sub 84 restrains a spring loaded mandrel 86 in a position where locking keys or dogs 78 of the mechanism 68 are de-supported, and the mechanism is thus disengaged. Additional force then applied to the connecting rod 114 causes a shoulder 82 on the rod 114 to snap through the collet 76. The connecting rod 114 travels a short distance further downhole until the fluted running sub 84 on the connecting rod releases the mandrel 86, which moves down to support the keys 78, which engage in a recess 80. The valve 100 is then located in the SSSV 62. In use, the fluted running sub 84 permits fluid flow up the production tubing between flutes on the sub. The valve 100 includes appropriate rotary/axial seal units 119 at a lower end, which provide a seal between the rotating connecting rod 114 and the valve housing 102, and the valve 100 is now fully latched into the SSSV 62 and ready for use.

It will therefore be understood that the valve 100, whilst being of similar structure to the valve 1, is operated utilising existing downhole equipment provided for operating the now-defunct SSSV 62. This avoids a requirement to carry out an expensive recovery and replacement of the SSSV 62, and thus minimises downtime.

Figures 4A, 4B, 4C:
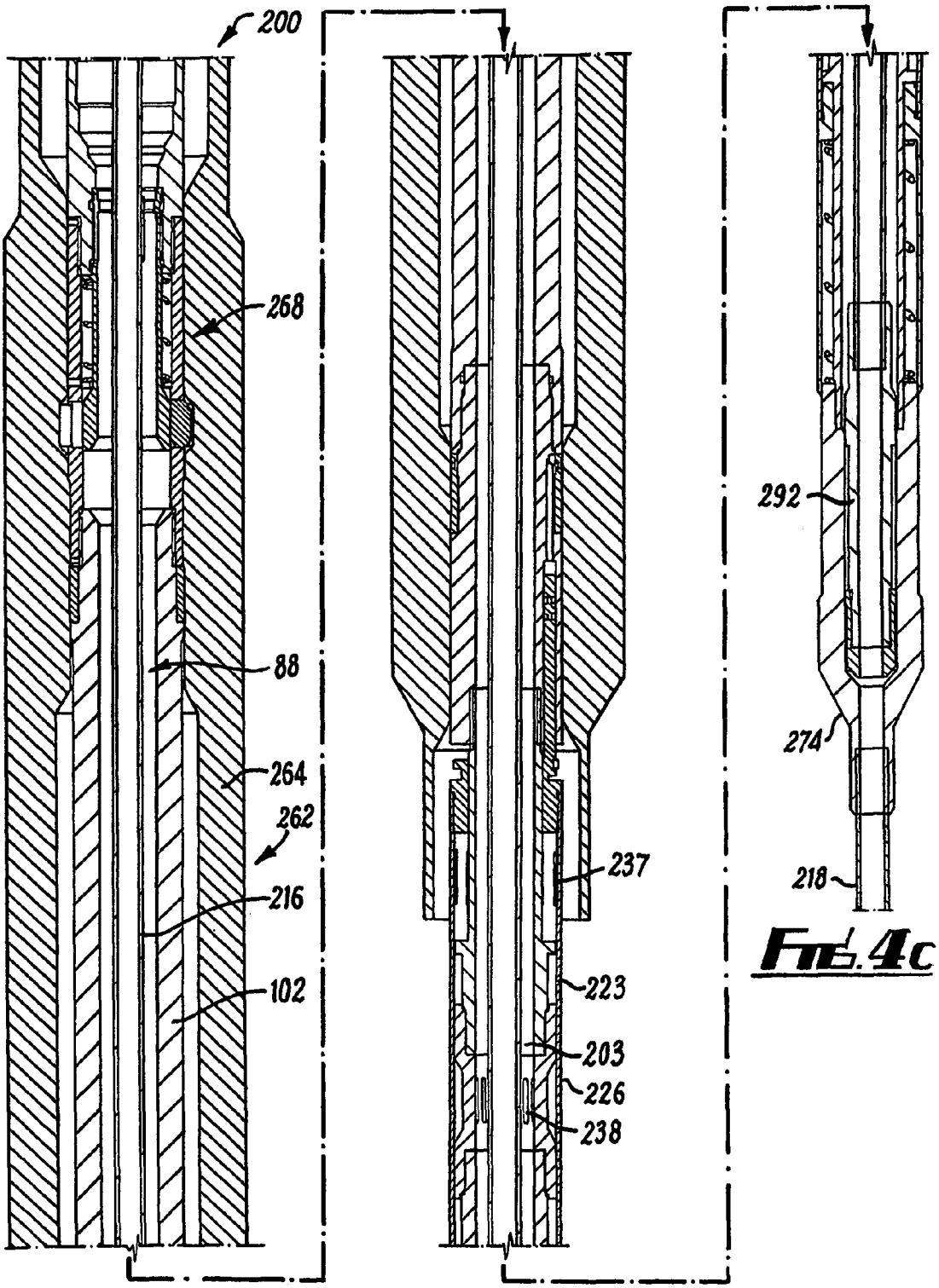
FIGS. 4A to 4C are longitudinal sectional views, from top to bottom, of a safety valve in accordance with a further alternative embodiment of the present invention.

Turning now to FIGS. 4A to 4C, there is shown sequentially from top to bottom a longitudinal sectional view of a safety valve in accordance with a further alternative embodiment of the present invention, the safety valve indicated generally by reference numeral 200. An upper end of the safety valve is thus shown in FIG. 4A and a lower end in FIG. 4C. Like components of the safety valve 200 with the valve 1 of FIGS. 1 and 2 share the same reference numerals incremented by 200, and with the valve 100 of FIGS. 3A to 3C, share the same reference numerals incremented by 100 or 200, as appropriate. Only the substantial differences will be described herein in detail.

Figure 5:
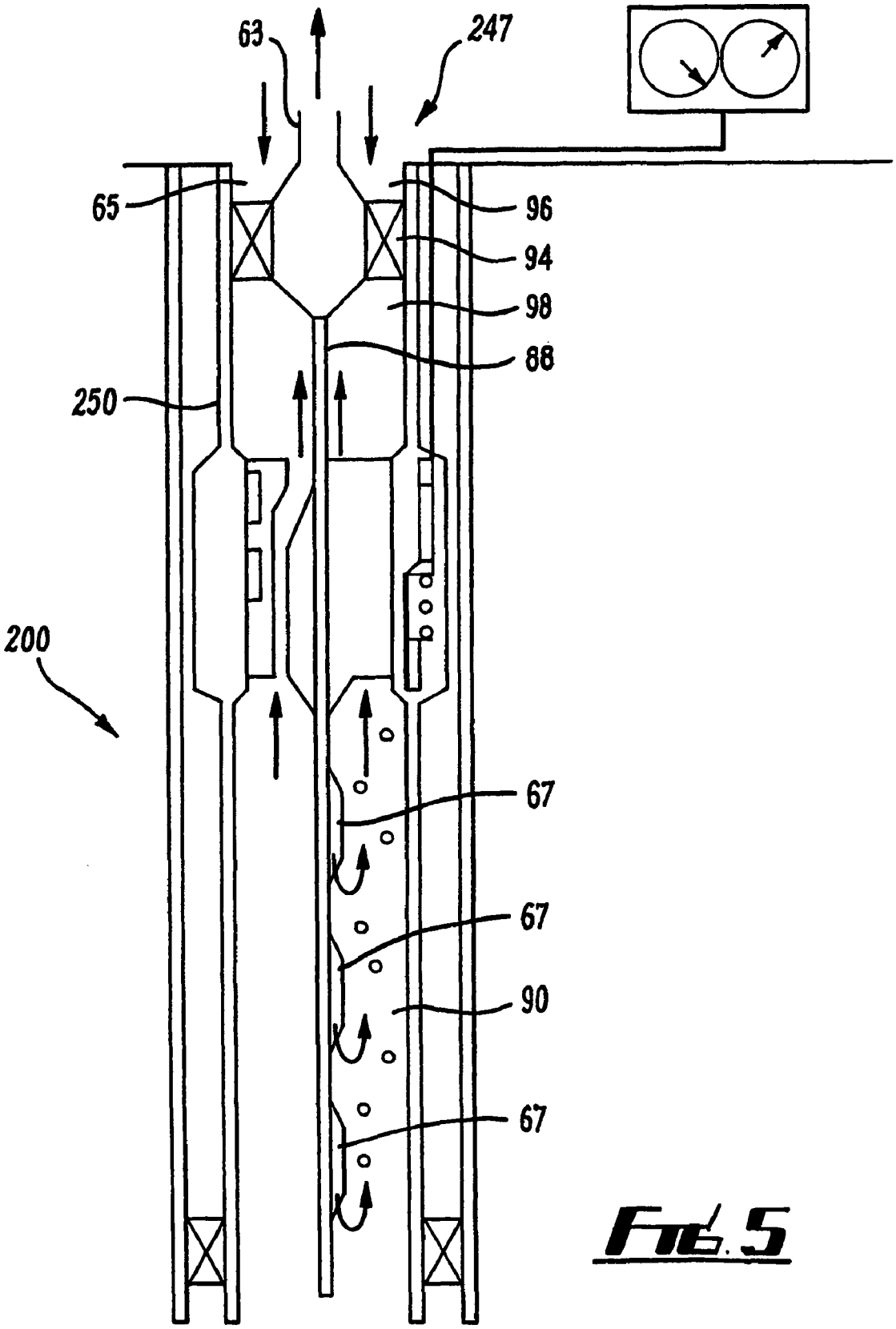
FIG. 5 is a schematic view of the safety valve of FIGS. 4A to 4C shown in use, disposed within a wellbore.

The valve 200 is essentially of similar structure to the valve 100, save that the valve 200 is shown in use with gas lift tubing 88 in an artificial lift procedure, which is illustrated in the schematic view of FIG. 5. In the gas lift procedure, gas is injected into a region 90 of the production tubing 250 (where well fluids enter the production tubing), to reduce the hydrostatic pressure of the column of fluid in the production tubing in the region 90. The resulting reduction in bottomhole pressure allows well fluids to enter the wellbore 247 at a higher flow rate, thereby stimulating production.

The valve 200 includes a coupling member in the form of a stab-in body 292, which is designed to stab-into a lower sub 274 of the valve 200, and carries appropriate seals for sealing the body 292 in the sub 274. The body 292 is threadably connected to a lower end of an upper conduit in the form of an upper gas lift tubing string 216, which forms part of the gas lift tubing 88. A lower conduit in the form of a lower gas lift tubing string 218 is threadably coupled to the lower sub 274, and the stab-in body thereby serves for fluidly coupling the upper and lower gas lift tubing strings 216 and 218.

The valve 200 is shown latched into an existing SSSV housing 264, in a similar fashion to the valve 100 of FIGS. 3A to 3C, and is thus run and latched using a locking mechanism 268 similar to the mechanism 68 of the valve 100. Additionally, a proprietary crossover packer 94 is provided above the upper gas lift string 216, which serves both to locate and restrain the gas lift pipe 88 within the valve housing 102, and to control flow of injected gas to the region 90 and produced well fluids to surface.

In more detail, the crossover packer 94 includes flow paths (not shown) which extend between the annulus in the area 96 and the gas lift pipe 88, and separate flow paths which extend between the annulus in the area 98 and a well fluid return tubing 63. Gas to be injected is directed along an annulus 65 defined between the production tubing 250 and the return tubing 63, flows through the packer 94 along the injection flow paths into the gas lift pipe 88, passes through the valve 200 and is injected into the production tubing 250 in the region 90 through flow ports 67. The stimulated, produced well fluids flow up an annulus defined between the production tubing 250 and an external surface 226 of a valve sleeve 223, through aligned ports 238 and 237, along a central bore 203 of the valve 200 and into the region 98, as indicted by the arrows in FIG. 5. The well fluids then flow through the crossover packer 94 return flow paths and into the return tubing 63 and thus to surface.

In this embodiment of the invention, there is no rotation of the gas lift pipe 88 and thus it is not necessary to transfer rotation between the upper and lower gas lift strings 216 and 218. Whilst the above embodiment has been described in relation to a gas lift pipe located within an existing SSSV 262, it will be understood that the valve 200 may be of like structure to that of the valve 1 of FIGS. 1 and 2 and thus designed as a primary valve, rather than a remedial valve to be located in existing valve structures.

Figure 6:
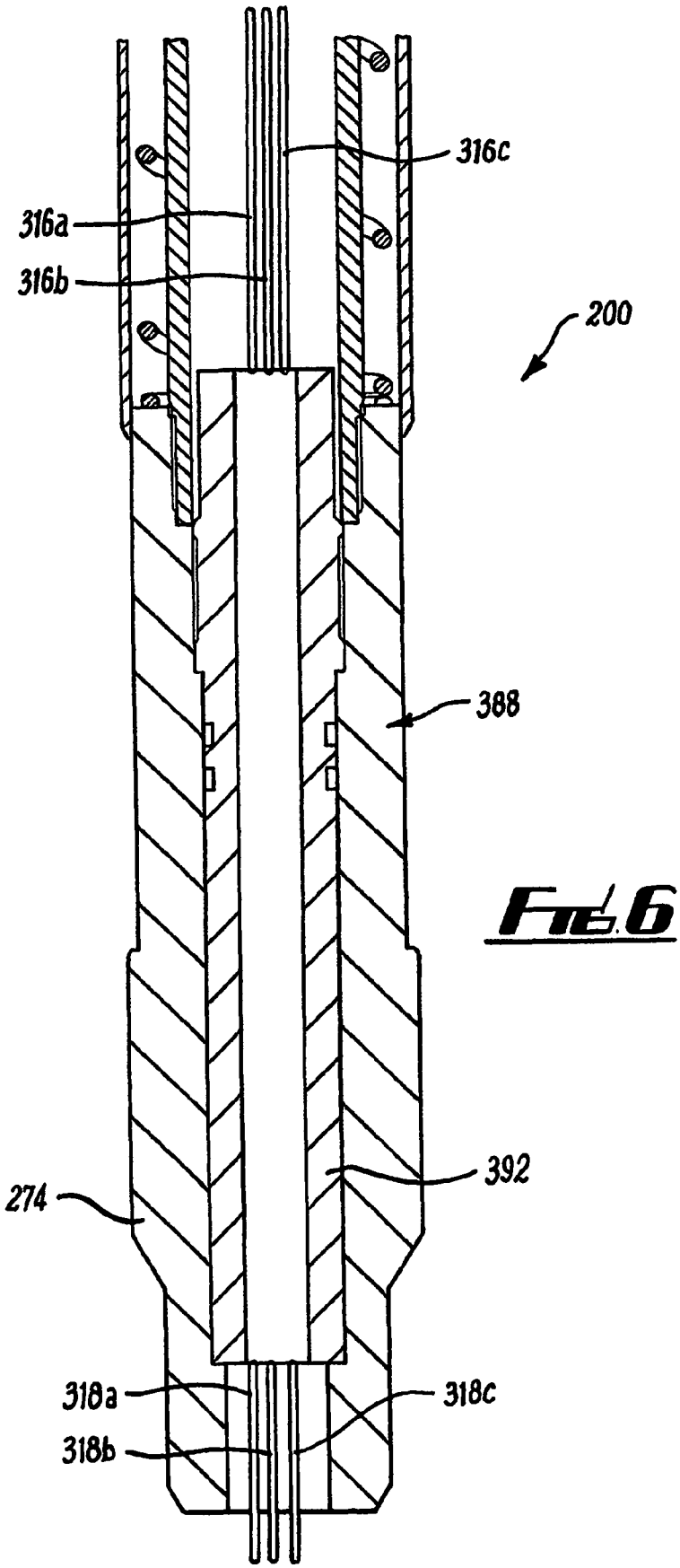
FIG. 6 is a view of a penetrator for use with a safety valve in accordance with a yet further alternative embodiment of the present invention.

The valve 200 may be employed with other types of non-rotary tubing or other strings. For example, turning to FIG. 6, there is shown an alternative string in the form of a penetrator string 388. Like components of the penetrator string 388 with the gas lift string 88 of FIGS. 4A to 4C share the same reference numerals, incremented by 300. The penetrator string 388 provides power for downhole equipment, such as an electrical submersible pump (ESP—not shown), used to stimulate well fluid flow. Additionally or alternatively, the penetrator string 388 can provide appropriate control signals for controlling the operation of downhole equipment such as the ESP, as will now be described.

The penetrator string 388 includes a stab-in body 392 which is designed to stab in and seal within the valve 200 lower sub 274, in a similar fashion to the body 292 on the gas string 88. The stab-in body 392 provides connection between upper conduits in the form of upper penetrator lines 316*a*, 316*b* and 316*c* and lower conduits in the form of lower penetrator lines 318*a*, 318*b* and 318*c*. The penetrator lines may comprise electrical power or control lines, fibre-optic control lines, hydraulic power or control lines or any desired combination thereof. Indeed, it will be understood that any desired or suitable number of penetrator lines may be provided for carrying out a desired downhole function.

In the illustrated embodiment, the upper penetrator lines 316 are coupled and sealed to the stab-in body 392 by a bushing (not shown) which is located in an axial bore (also not shown) that extends through the body 392. The lower penetrator lines 318 extend up through the bore and mate with the upper lines 316, to provide appropriate mechanical, electrical and/or fluid connection between the lines 316 and 318. This permits the desired downhole function to be carried out. The lines 316, 318 may be sealed using a suitable sealing compound if desired or required.

In the illustrated embodiment, the penetrator lines 316 are suspended within the well from surface, and the lower lines 318 suspended from the body 392. However, in an alternative arrangement, the penetrator lines 316 may be piggy-backed on an upper tubing string (not shown) and the lower penetrator lines (not shown) on a lower tubing string (not shown), which support the lines and permit further downhole functions, such as conveying fluids. Indeed, the connected tubing strings may provide a gas lift function similar to that described above. The stab-in body 392 may thus also provide connection between the upper and lower tubing strings, although the body 392 may be an annular member mounted on an external surface of the tubing string formed by connection of the upper and lower tubings.

In use, the penetrator string 388 is made up at surface and the body 392 is stabbed into the valve lower sub 274, sealing the body 392 to the valve 200. The penetrator string 388 is also coupled to the downhole equipment whose operation is to be controlled/powered through the string 388, such as the ESP. The valve 200 and associated equipment is then run and located within an existing SSSV, as described above. However, as is the case with the gas lift string 88, the valve 200 may be of like structure to that of the valve 1 of FIGS. 1 and 2 and thus designed as a primary valve, rather than a safety valve for location within existing valve structures. Following location downhole, power and control signals may be provided to operate the ESP through the connected penetrator lines 316, 318.

Further modifications and improvements may be added without departing from the scope of the invention herein described. For example, the rotary section of the embodiment described may be replaced with an axially movable member to allow the safety valve to be used with a rod pump.

The safety valve may be for use with any desired downhole/wellbore tubing, and a section of the downhole tubing itself may form the coupling member and may be adapted to be sealably mounted in the housing bore. Thus the coupling member may form part of a completed conduit string extending through the valve.

The invention claimed is:

1. A safety valve for use with upper and lower conduits located in wellbore production tubing, the safety valve comprising:

a housing having a longitudinal bore extending therethrough;

a coupling member for coupling the upper conduit to the lower conduit; and valve means operable between a first condition permitting fluid flow between the upper and lower conduits and a second condition in which such flow is blocked;

wherein the coupling member is sealably mounted within the longitudinal bore, an annular flow passage is provided which bypasses the coupling member, and the valve means is located in the annular flow passage.

2. A safety valve as claimed in claim 1, for use with an upper conduit in the form of an upper tubing string and a lower conduit in the form of a lower tubing string.

3. A safety valve as claimed in claim 1, wherein the coupling member serves for fluidly coupling the upper conduit to the lower conduit, to permit fluid flow therebetween.

4. A safety valve as claimed in claim 1, for use with gas lift tubing comprised of upper and lower conduits in the form of upper and lower tubing strings, where an upper gas lift tubing string is coupled to a lower gas lift tubing string by the coupling member.

5. A safety valve as claimed in claim 1, wherein the coupling member is adapted to be connected to one of the upper and lower conduits, and wherein the housing is adapted to be connected to the other one of the upper and lower conduits.

6. A safety valve as claimed in claim 1, wherein the coupling member is adapted for directly connecting the upper and lower conduits together.

7. A safety valve as claimed in claim 1, wherein the coupling member comprises a tubing section.

8. A safety valve as claimed in claim 7, wherein the coupling member is adapted to form part of a completed conduit extending through the valve.

9. A safety valve as claimed in claim 1, for use with a penetrator, wherein the coupling member takes the form of a penetrator body, the penetrator body adapted for coupling the upper and lower conduits in the form of upper and lower penetrator conduits.

10. A safety valve as claimed in claim 9, wherein the upper and lower penetrator conduits take the form of conduits selected from the group comprising tubes, pipes, wires and cables.

11. A safety valve as claimed in claim 1, wherein the coupling member takes the form of a motion transferring member arranged to provide a means to transfer motion from the upper conduit to the lower conduit.

12. A safety valve as claimed in claim 11, wherein the safety valve is for use with upper and lower conduits in the form of upper and lower rod strings of a pump.

13. A safety valve as claimed in claim 11, wherein the safety valve is for use with upper and lower conduits in the form of upper and lower sections of a drill string.

14. A safety valve as claimed in claim 11, wherein movement of the motion transferring member is restricted to rotational motion.

15. A safety valve as claimed in claim 11, wherein movement of the motion transferring member is restricted to axial motion.

16. A safety valve as claimed in claim 11, wherein the safety valve is for use with upper and lower rod strings of a rod pump.

17. A safety valve as claimed in claim 1, wherein the annular flow passage and valve means therein provides a fluid path which can be opened and closed to regulate flow in a production string.

18. A safety valve as claimed in claim 1, wherein the valve means comprises an annular valve.

19. A safety valve as claimed in claim 18, wherein the annular valve is adapted to be opened to selectively permit fluid flow up the annular passage and into the production tubing, bypassing the coupling member.

20. A safety valve as claimed in claim 18, wherein the annular valve comprises a hollow cylindrical valve sleeve surrounding a hollow cylindrical valve body.

21. A safety valve as claimed in claim 20, wherein the cylindrical valve body is an integral part of the inner cylindrical housing.

22. A safety valve as claimed in claim 20, wherein the valve sleeve is movable along the valve body.

23. A safety valve as claimed in claim 20, wherein the valve sleeve has at least one valve sleeve aperture, and the valve body has at least one valve body aperture, and wherein the valve is open when the valve sleeve is in a position where the at least one valve sleeve aperture is aligned with the at least one valve body aperture.

24. A safety valve as claimed in claim 20, wherein the annular valve has an actuation means which displaces the valve sleeve of the annular valve.

25. A safety valve as claimed in claim 24, wherein the actuation means for the annular valve is a rod piston.

26. A safety valve as claimed in claim 25, wherein the rod piston is located in a longitudinally extending rod piston cavity and is axially moveable therein.

27. A safety valve as claimed in claim 26, wherein movement of the rod piston is effected by means of hydraulic fluid pressure within the rod piston cavity.

28. A safety valve as claimed in claim 25, wherein the rod piston cavity is in fluid communication with a hydraulic control line port located in the valve housing.

29. A safety valve as claimed in claim 28, wherein there is an intermediary stage between the hydraulic control line port and a control line of the safety valve.

30. A safety valve as claimed in claim 29, wherein the intermediary stage is a component of a downhole fixture located in the wellbore.

31. A safety valve as claimed in claim 25, wherein the rod piston is spring biased to a default position where the valve means is closed.

32. A safety valve as claimed in claim 1, wherein the coupling member comprises a hollow, substantially cylindrical body.

33. A safety valve as claimed in claim 1, wherein the housing comprises an outer hollow cylindrical housing portion and an inner hollow cylindrical housing portion with the annular flow passage provided therebetween.

34. A safety valve as claimed in claim 1, wherein the safety valve is adapted to be located in an existing downhole valve.

35. A safety valve as claimed in claim 34, wherein the existing downhole valve is a sub-surface safety valve (SSSV) and is locked open.

36. A safety valve as claimed in claim 35, wherein the SSSV is a tubing retrievable surface controlled safety valve (TRSCSV).

37. A safety valve as claimed in claim 34, wherein the existing valve is adapted to be locked open and wherein the safety valve is adapted to engage within a main bore of the existing downhole valve.

38. A safety valve as claimed in claim 1, wherein sealing means are provided between the coupling member and the housing.

39. A safety valve as claimed in claim 1, comprising a female receptacle for connecting the coupling member to the upper conduit, the female receptacle integral to one of the coupling member and the upper conduit, and a male insert on the other one of the coupling member and the upper conduit.

40. A safety valve as claimed in claim 39, wherein the male insert comprises a splined shaft, and the female receptacle comprises a splined sleeve into which the splined shaft forms an interference fit capable of transferring rotational motion.

41. A safety valve as claimed in claim 39, wherein the male insert further comprises a locking mechanism for holding the splined shaft within the splined sleeve, to selectively prevent retraction of the upper conduit from the valve housing.

42. A safety valve as claimed in claim 41, wherein the locking mechanism comprises a key, and the female receptacle comprises a recess with which the key can communicate such that as the male insert is engaged with the female receptacle, the key locates within the recess and prevents the upper conduit from being forced upwards.

43. A safety valve as claimed in claim 41, wherein the male insert further comprises a non-rotating mandrel, and wherein the locking mechanism is an integral part of the non-rotating mandrel.

44. A safety valve as claimed in claim 43, wherein the upper conduit is free to rotate within the non-rotating mandrel.

45. A safety valve as claimed in claim 39, wherein the male insert further comprises a no-go key and the female receptacle further comprises a shoulder with which the no-go key communicates to prevent further downward travel of the upper conduit.

46. A safety valve as claimed in claim 39, wherein the means of connecting the coupling member to the lower conduit further comprises a torque reducing means for reducing transfer of backlash torque into the safety valve.

* * * * *